United States Patent [19]

Johnson et al.

[11] Patent Number: 4,702,694

[45] Date of Patent: Oct. 27, 1987

[54] FURNACE WITH MODULAR CONSTRUCTION

[75] Inventors: Clyde R. Johnson, Claysville; Raymond Hawryluk, Upper St. Clair; Gerald Katrencik, Houston, all of Pa.

[73] Assignee: Union Oil Company of California, Los Angeles, Calif.

[21] Appl. No.: 646,353

[22] Filed: Aug. 31, 1984

[51] Int. Cl.[4] ..... F27B 9/00

[52] U.S. Cl. ..... 432/133; 432/139; 34/178

[58] Field of Search ..... 34/178, 173; 432/80, 432/133, 139, 152; 110/247

[56] References Cited

U.S. PATENT DOCUMENTS

| | | | |
|---|---|---|---|
| 730,564 | 6/1903 | Perkins | 34/178 X |
| 1,666,617 | 4/1928 | Caldwell | 34/178 X |
| 3,962,128 | 6/1976 | Nelson et al. | 432/139 |
| 4,391,208 | 7/1983 | Lewis | 432/139 |

*Primary Examiner*—Henry A. Bennet

*Attorney, Agent, or Firm*—Dean Sandford; Gregory F. Wirzbicki; Robert A. Franks

[57] ABSTRACT

A multiple hearth furnace is constructed from a plurality of cylindrical heating chamber modules, connected in a vertical configuration. Each module contains a hollow hearth, which forms a floor in the chamber, the hearth having an open portion approximately centered in the chamber floor. A rotating central shaft is disposed vertically through open portions in the hearths and is provided with projections for distributing material to be heated across the hearths. Heating of the modules is accomplished by passing heated gases through the hollow hearths. Material to be heated is introduced into the uppermost module, is distributed across the hearth, and is discharged into successively lower modules, after which material exits the furnace. Gases which form during the heating can be removed separately from gases used to heat the furnace.

19 Claims, 3 Drawing Figures

FURNACE WITH MODULAR CONSTRUCTION

BACKGROUND OF THE INVENTION

1. Field of the Invention

The invention relates to the field of roasting furnaces, and more particularly to furnaces which have multiple, vertically stacked hearths.

2. Description of the Art

Multiple hearth furnaces have been in use for many years, primarily in the mineral processing industry for purposes such as ore roasting, drying, and calcining (e.g., the production of lime from limestone). Commercial furnaces include several variations, such as the Herreshoff, Nichols, Wedge, Skinner, and other designs. In general, these devices are fabricated using a metal exterior structure, lined with refractory and having refractory hearths which define the limits of roasting chambers. Heat is applied by fuel burners, which introduce combustion gases directly into one or more of the vertically stacked chambers. Heat is not applied evenly, resulting in higher- and lower-temperature areas above given hearths, and uneven roasting, drying, or calcining conditions.

Even more serious, however, are disposal problems with gases from the furnaces. For example, the roasting of sulfide ores generally requires a large amount of air introduction, both for maintaining a sufficient oxygen concentration to permit sulfide sulfur to form sulfur oxides, and for cooling to minimize "hot spots" in the furnace. As a consequence, the sulfur oxide effluent not only contains combustion products from the burners and dust (composed of furnace feed and roasted products), but is diluted with air. It is no longer environmentally acceptable to simply release sulfur oxides into the atmosphere, but sulfur oxide recovery is made more difficult by the contaminants. Indirectly heated furnaces are known, as taught by Leggo in U.S. Pat. No. 837,576. FIG. 42 of the patent shows a four-chamber furnace constructed of bricks, wherein heat is supplied beneath the chambers from burners located in "fire boxes" adjacent to the chambers. Separate systems are present for removing gases from the chambers and combustion gases.

The disadvantages of brick construction include difficulty of making repairs without completely rebuilding large sections or all of a structure, a lack of versatility in forming desired shapes and configurations, permanence of the structure when changes are desired, poor heat transfer characteristics through the bricks, and contamination of materials passed through the furnce, due to abrasion or spalling of the bricks. Several of these disadvantages are also present in the modern multiple-hearth furnace, which utilizes refractory insulation and hearths inside the furnace.

Accordingly, it is an object of the present invention to provide a multiple hearth furnace which can be easily constructed, repaired, and operated.

It is a further object to provide a furnace having modular construction, permitting ease of modification for accomplishing various operations.

Another object is to provide a furnace which can be used to produce high-purity chemical products.

An additional object is to provide a furnace in which the inclusion of large quantities of dust in the gases discharged from the furnace will be avoided.

A still further object is to provide a furnace wherein the combustion gases can be discharged or utilized for other heating purposes, without treatment for pollution abatment.

Yet another object is to provide a furnace wherein gases from the heated chambers can be separately collected for treatment or recycling.

These and other important objects will become more apparent to those skilled in the art, from consideration of the following description of the invention.

SUMMARY OF THE INVENTION

The invention pertains to a multiple hearth furnace, which has a plurality of heating chamber modules connected in a vertical stack configuration. An additional module, containing only a hollow hearth, is connected above the uppermost heating chamber module. Each module is heated by means of hollow hearths forming a floor in the module, through which heated gases are passed. Material to be heated is introduced into the uppermost heating chamber, is distributed over the hearth of that chamber, and is discharged to the next lower chamber. Following distribution of the material on the lower chamber hearth, the material is discharged to the next lower chamber; this is repeated until material reaches the lowermost chamber where, after distribution, the material exits the furnace.

All hearths have openings in their centers, through which a shaft is passed. The shaft is equipped with arms and is rotated to distribute the material over the hearths.

Gases used to heat the hearths are maintained separately from gases in the heating chambers, due to the hollow heating hearth design.

DESCRIPTION OF THE INVENTION

The invention is directed to a modular multiple-hearth furnace, in which heating chamber modules are assembled in any desired number, at least two, to obtain a particular heating temperature program. The furnace is configured such that combustion gases can be maintained separately from gases which may form during the heating of material fed to the furnace, facilitating recovery of such formed gases for pollution abatement or for economic considerations, such as recycling into a process.

Figure 1:
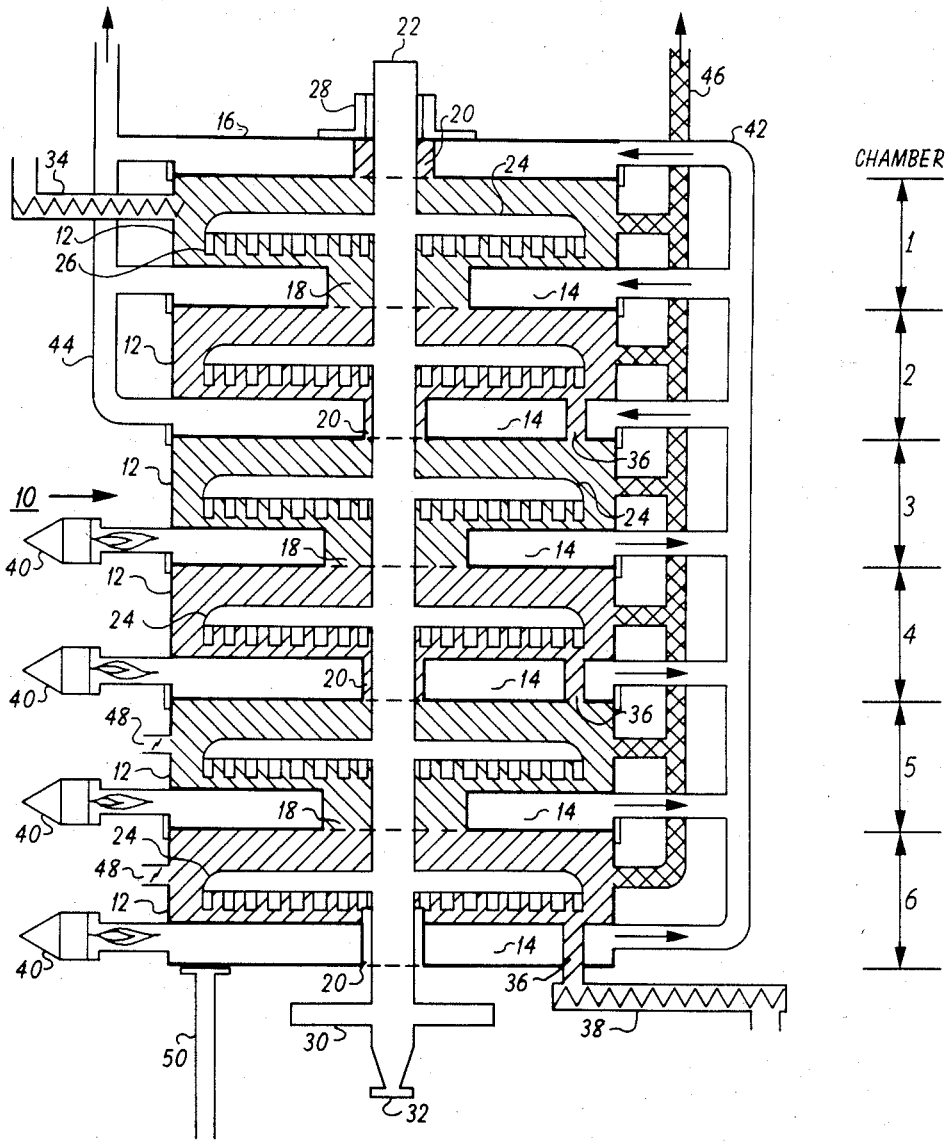
FIG. 1 is a diagram showing the major structural components and internal configuration of a furnace constructed according to the invention.

Referring to FIG. 1, furnace 10 is shown, for purposes of example, as containing six heating chambers, numbered with the first being the uppermost chamber. This first chamber is formed by a furnace module 12, which contains hollow heating hearth 14 as its floor, and an upper hollow heating hearth module 16. Lower chambers 2 through 6 are formed by additional furnace modules 12, with the bottoms of hearths 14 forming ceilings for the lower chambers. Dashed lines denote the lower extremes of hearth module 16 and the furnace modules 12.

Each furnace module 12 has a generally cylindrical shell. Hollow heating hearths 14 and 16 do not cover the entire floor area of the cylinders, but have open portions at the center of the cylinder floor, to provide a generally circular opening in the center of the floor. Openings 18 in the floors of odd-numbered roasting chambers are considerably larger in diameter than openings 20 in even-numbered chambers and in the upper hearth module.

Shaft 22 is disposed vertically through the center of the furnace, within openings 18 and 20 of the hearths. Laterally extending projections 24 are attached to the shaft, numbering at least one per roasting chamber. The projections, sometimes called "rabble arms," should be slightly shorter in length than the radius of a heating chamber, and are located near the floor of the chamber, each fitted with a plurality of vane-like protrusions 26, sometimes called "rabbles," extending from the lower surface of the rabble arms. Shaft bearing 28 is located at the top of the furnace to maintain positioning of the shaft; a similar bearing (not shown) can be mounted at the furnace bottom for further positioning. Rotational movement of the shaft and its attached rabble arms is provided by gear 30, usually coupled to a pinion (not shown) on a suitable motor (not shown). Alternative drive mechanisms, such as hydraulic drives, can be used in place of the motor and gearing system. Variable speed drives are preferable, since, for a given material feed rate, the rotational speed of the shaft determines the depth of material on a hearth.

For high temperature roasting, it can be necessary to cool the shaft and rabble arms. This can be accomplished by making the shaft and arms hollow, and passing a cooling fluid through the assembly. For example, air or other gases can be introduced through flanged opening 32 and allowed to exit openings provided along the length of the various rabble arms, into the heating chambers. Fluid flow rates will be adjusted to obtain the required amount of cooling.

Particulate material to be heated in the furnace is introduced near the periphery of the first chamber, such as through screw conveyor 34. Many other devices for introducing material are known in the art, such as belt feeders, vibrating plates fed by hoppers, and the like. Any of the known devices can be adapted for use with the furnace of the invention.

In the chamber, the rotating rabble arms and rabbles distribute and mix the material over the surface of the hearth. Rabbles in this, and the other odd-numbered chambers, are angled with respect to their rabble arms such that rotational movement directs the particles inwardly, toward opening 18 in the center of the chamber. Upon reaching this opening, the particles fall into the chamber below, in which (and in other even-numbered chambers) rabbles are angled such that particles are directed outwardly, toward opening 36 near the periphery of the chamber. Upon reaching this opening, the particles fall into the next chamber below. Thus, particles are directed inwardly and outwardly on succeeding hearths, as the particles move from the uppermost chamber to the lowermost chamber. Finally, particles are directed in chamber 6 to opening 36 and out of the furnace, such as through screw conveyor 38.

Heat to the furnace is supplied by fuel burner and burner chamber assemblies 40, shown as directing combustion gases into the hollow hearths of chambers 3 through 6. The burner chambers maintain sufficient space between the burners and the hollow hearths to prevent direct flame impingement upon metal surfaces of the hearths. Such spacing assists in preventing distortion of the metal surfaces which could result from excessive localized temperature increases. This arrangement permits good control over heat input to the individual hearths. Any number of hearths can be heated by the combustion gas from a single burner, such as by means of a manifold (not shown) connecting hearths, with dampers provided to attenuate or increase gas flow into the hearths.

Gases pass through the hearths into duct 42, which in turn directs the gases through the hearths of chambers 1 and 2, and the upper hearth module. A hearth exhaust duct 44, located on the opposite side of the furnace from duct 42, exhausts combustion gases from the furnace. This arrangement will result in cooler temperatures for chambers 1 and 2 than for other chambers, since gases entering these upper hearths will have dissipated considerable heat while passing through the lower hearths. It should be apparent that other combustion gas flow schemes can be utilized. For example, a burner could be used for each hearth, in which event duct 44 would not be needed, since duct 42 would be used to conduct gases away from the furnace. Alternatively, fewer burners could be utilized, whereupon duct 44 would provide a combustion gas outlet for more than just hearths of the upper two chambers. Typically, combustion gases will be used to heat more than one chamber, to more effectively utilize heat contained in the gases and give a lower temperature furnace exhaust gas.

Gases formed within the chambers, such as water vapor from drying operations, or gaseous products of chemical reactions occurring upon heating, are removed by means of chamber exhaust duct 46. If cooling air has been introduced into the chambers, as previously described, it will also be a component of the removed gases. Due to the low total gas flow rate within the chambers, little dust or other contamination will normally be found in these flue gases, a distinct advantage over furnaces which introduce combustion gases at high velocity directly into the chambers.

In addition, openings 48, shown with optional dampers installed, can be utilized on all or selected chambers to introduce air or other gases, as may be desired to maintain a particular atmosphere in the chambers. Different chambers could be given different atmospheres, as desired, in which event it may also be desirable to provide separate chamber exhaust ducts 46 for chambers having different atmospheres, to facilitate pollution abatement treatment of the gases or recovery of gaseous products.

A conventional multiple hearth furnace heats only an upper layer of material on a hearth. As additional subsurface material is exposed by rabbles, it also becomes heated. However, the present hollow hearth design results in a more uniform heating profile, since heat radiates upward through material on a hearth, and downward from the hearth above the material.

The temperature of material on the hearth of a conventional furnace cannot be accurately measured or controlled, since subsurface material is not heated until a rabble exposes it. However, using the furnace of this invention, temperature probes inside the hearths and other probes inside the heating chambers can be used with an automatic burner controller to obtain accurate, reproducible, and rapidly responding temperature control of the heated material.

Components of the furnace are preferably constructed of metal, for maximum heat transfer from combustion gases into the chambers. Many furnace components can be at least partially formed by casting, permitting a very low fabrication cost. Components can be assembled, where required, by any technique known in the art, such as welding, bolting, riveting, and the like, as may be desired for a particular furnace. The type of metal used will normally be determined by the nature of material which is to be heated, for proper resistance to corrosion. A further advantage of metal construction is the elimination of heated product contamination which is found in refractory-lined furnaces, due to spalling or abrasion of the refractory; this permits the production of high-purity chemicals. However, due to the significant expansion and contraction of metals with temperature changes, furnace mountings, such as support post 50, should not be rigidly attached to surfaces of the furnace. Further, any component which is rigidly attached to furnace surfaces, such as a burner chamber or a screw conveyor, must not also be rigidly attached to any exterior supports, due to possible movement of the furnace surface from expansion and contraction with temperature changes.

Figure 2:
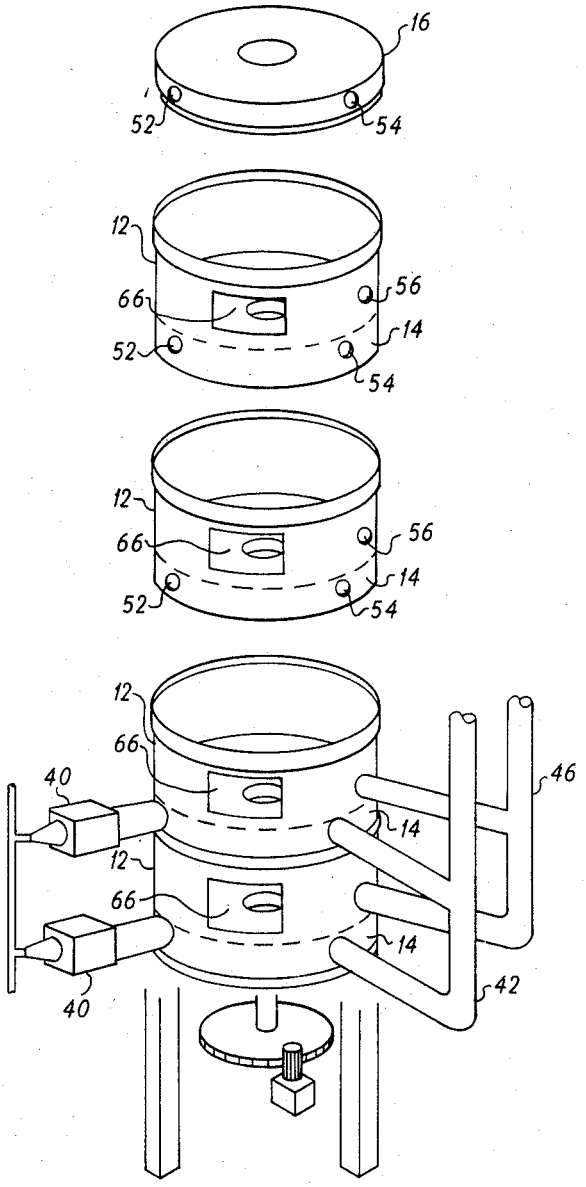
FIG. 2 displays the exterior relationship of modules, which can be connected to form a furnace according to the invention.

The relationship of major structural components of the multiple hearth furnace is further illustrated in FIG. 2, which shows an assembly of four furnace modules 12 and a heating hearth module 16. Note that reference numbers are maintained from FIG. 1 for corresponding components, to better display the relationships between the components. Dashed lines near the bottom of the furnace modules denote the upper limit of the hollow hearth portions 14.

The two lower furnace modules are shown as fitted with burners 40 for heating the hearths. Combustion gases exit these hearths into duct 42. If desired, any of the two upper furnace modules and the hearth module can also be fitted with burners at opening 52. Alternatively, any of these modules can be heated with exhaust gases from the lower hearths, by connecting duct 42 to opening 54 and connecting an exhaust duct (not shown) to opening 52. From the exhaust duct, gases are discharged into the atmosphere or utilized for other plant heating requirements.

Heating chamber portions of the furnace modules are provided with openings 56 to remove gases therefrom. In the lower two modules, these openings are shown as connected to duct 46; typically, unless different chambers are maintained under different atmospheres, duct 46 will be connected to all openings 56, and will either conduct removed gases to a treatment or recycling facility or discharge them to the atmosphere.

Figure 3:
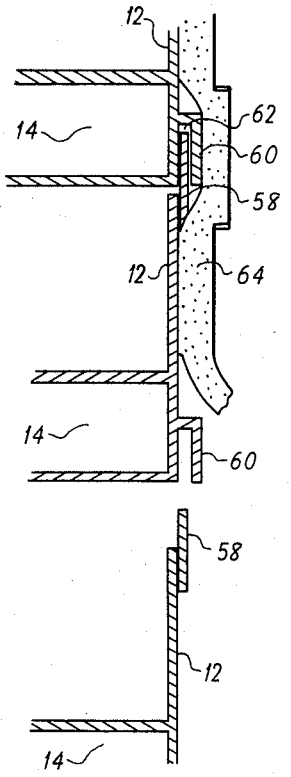
FIG. 3 is a diagram showing, in detail, a method for connecting modules to form a furnace of the invention.

FIG. 3 shows, in greater detail, a method for assembling the furnace of the invention. Referring to the drawing, portions of three furnace modules 12 are shown, with their hollow hearth sections 14 identified. Each furnace module is equipped, around the outside of its upper edge, with engaging member 58 extending beyond the upper edge. This member is adapted to fit within a channel 60, fastened to a different furnace module around the outside of its lower edge. The engaging member and channel can be attached to their modules by any suitable method, such as by welding.

For permanent installations, modules can be assembled using spot or continuous welding around the interlocked engaging members and channels, to prevent the possibility of relative rotational shifting of the modules. For less permanent installations, it will normally not be necessary to fasten the modules together, since their weights will prevent relative movement. Optionally, the modules can be provided with, for example, flanges which will enable fastening of adjoining modules by bolts and the like.

Also shown is packing material 62, which can be a rope of high-temperature insulating material, placed within the channel before assembly of the furnace to prevent gas leakage from the heating chambers. After assembly of the furnace, its metal construction makes very desirable an outer layer of insulating material 64, which can be fiberglass batting, kaolin wool, and the like.

The modular furnace design permits a very economical construction, since the various components can be fabricated to specifications in a machine shop and easily assembled by relatively unskilled craftsmen at a work site. Although not shown in the drawings, components such as the shaft and ducts can be fabricated in sections, with flanges, for example, provided to connect the sections. Such techniques will permit rapid changes in the furnace configuration (such as number of heating chambers, number of burners, etc.), to conform with changes in the intended purpose for the furnace (such as from drying to roasting, or for adding or removing modules) or for furnace maintenance (such as replacing damaged or corroded components). In addition, access ports 66 (FIG. 2) can be provided in the heating chambers to facilitate maintenance operations, such as cleaning.

Metals to be used for fabricating the furnace will be selected based upon temperatures which are to be utilized and the corrosivity of feed materials, heated products, and any gaseous products of the heating. Stainless steel furnaces have been found satisfactory for the production of high-purity molybdenum oxide, by heating ammonium molybdates at temperatures up to about 1050° F. Many less corrosion-resistant metals will also be useful for furnace construction, particularly where the furnace is to be used for heating materials having a low reactivity, or for lower temperature operations such as drying.

It should be noted that several variations of the previously described furnace assembly are contemplated within the scope of the present invention. For example, a furnace can be constructed using heating chamber modules which are simply cylindrical rings. Hollow hearth modules (shown as 16 in FIGS. 1 and 2) can be disposed above the uppermost heating chamber module, below the lowermost heating chamber module, and between heating chamber modules. Fabrication of the various modules will be facilitated, due to this design simplification, and component replacement will be made easier and less expensive, since it will not be necessary to replace a heating chamber if only a hearth becomes defective.

In addition, further heat utilization can be obtained by a double-wall construction for the heating chamber modules, wherein combustion gases are passed through open spaces between the interior and exterior walls. This will also permit greater weights to be supported by the lower modules when a large number of modules are to be stacked.

The invention is further illustrated by the following example, which is illustrative of various aspects of the invention and is not intended as limiting the scope of the invention as defined by the appended claims.

EXAMPLE

A two-hearth furnace is constructed, according to the invention, using type 304 stainless steel. Furnace modules are cylinders of ¼-inch-thick sheet metal, approximately 72 inches inside diameter, the upper module having a heating chamber approximately 15-½ inches in height and a hollow heating hearth as its floor, measuring approximately 6 inches in height. The lower module has a heating chamber approximately 17-½ inches in height and a hollow heating hearth approximately 6 inches in height. A hollow heating hearth module, having approximately a 6-inch height, is placed over the upper module. Each of the three hearths is directly heated by a burner, mounted in a burner chamber outside the hearth; the burners are fed with natural gas and combustion air from a blower.

The hearths are constructed with interior baffles, to direct combustion gases from the burners more uniformly about the interior of the hearths and prevent large temperature gradients between different regions on a particular hearth. In addition, the hearths are provided with internal bracing, to prevent distortion of the structure during periods of rapid temperature change, such as the start-up and cool-down modes of furnace operation.

Passing vertically through the center of the furnace is a hollow shaft, having an outside diameter approximately 5-¾ inches. The shaft is fitted with four rabble arms for each heating chamber, spaced at 90° intervals around the shaft. Each rabble arm is provided with 10 rabbles, spaced such that total coverage of the hearth area will be obtained as the shaft rotates. An opening of approximately 12-¼ inches diameter in the hearth of the upper furnace module permits heated material to fall into the lower hearth, after traversing the upper chamber hearth from an introduction point near its periphery. An opening approximately 6 inches by 6 inches, near the periphery of the hearth of the lower furnace module, allows heated material to exit the furnace, after traversing the lower chamber hearth.

Each hearth is provided with a 6-inch diameter opening, opposite the point of introducing combustion gases, for connection to an exhaust duct. Each of the heating chambers is provided with two 3-inch diameter openings, for the introduction of air into the chambers, and one 6-inch diameter opening for the removal of introduced air and any gases formed by heating material in the furnace.

The furnace is elevated above ground level by a frame of four vertical 8-inch steel posts, connected by two cross members upon which the furnace is placed. No fasteners are used to attach the furnace to the cross members, permitting unrestrained expansion and contraction of the furnace with temperature changes.

The entire exterior shell of the furnace is covered with 2-inch-thick kaolin wool insulation, and a wire mesh retainer for the insulation is formed around the outside.

After the heating chambers have been heated to about 980° F., ammonium molybdate is fed into the upper chamber at a rate up to about 200 pounds per hour. Molybdenum oxide product is recovered from the lower chamber. A mixture of air and ammonia is removed from the heating chambers and is utilized for the preparation of ammonium molybdate. Combustion gases discharged to the atmosphere are uncontaminated with either ammonia vapor or dust from the heating chamber.

Various embodiments and modifications of this invention have been described in the foregoing description and example, and further modifications will be apparent to those skilled in the art. Such modifications are included within the scope of the invention as defined by the following claims.

What is claimed is:

1. A furnace comprising:

(a) a plurality of heating chamber modules connected in a vertical stack configuration, each module comprising a heating chamber and a hollow hearth which forms a substantially horizontal floor in the chamber;

(b) means for introducing material to be heated into the furnace;

(c) means for removing the material from the furnace; and (d) means in the heating chamber periphery of each module for removing gases which form in that module during heating of the material.

2. The furnace defined in claim 1, wherein the hearth is provided with an open portion approximately centered in the chamber floor.

3. The furnace defined in claim 2, wherein the material to be heated is distributed across the floor by distributing means comprising a shaft extending vertically through open portions in the hearths.

4. The furnace defined in claim 1, wherein the modules are heated by passing heated gases through hollow hearths.

5. The furnace defined in claim 1, further comprising:

(f) a cover disposed over an uppermost heating chamber module.

6. The furnace defined in claim 5, wherein the cover comprises a hollow hearth.

7. The furnace defined in claim 1, wherein the modules are fabricated from metal.

8. The method defined in claim 7, wherein the modules are fabricated from stainless steel.

9. A furnace comprising:

(a) a plurality of metal heating chamber modules, each module provided with a hollow hearth which forms a substantially horizontal floor in the chamber, and each module provided with a means in the heating chamber periphery for removing gases which form in the chamber, the modules being connected in a vertical configuration;

(b) means for heating the hearths;

(c) means for introducting material to be heated into an uppermost module;

(d) means for transferring material to successively lower modules;

(e) means for distributing material upon each hearth; and (f) means for removing material from a lowermost module.

10. The furnace defined in claim 9, wherein the modules are generally cylindrical in shape.

11. The furnace defined in claim 9, wherein each hearth is provided with an open portion approximately centered in the chamber floor.

12. The furnace defined in claim 11 wherein the means for transferring material is open portions in the chamber floors.

13. The furnace defined in claim 11, wherein the means for distributing material comprises a shaft extending vertically through the open portions.

14. The furnace defined in claim 9, wherein the hearths are heated by passing heated gases therethrough.

15. The furnace defined in claim 9, wherein the modules are fabricated from stainless steel.

16. A furnace comprising:

(a) a plurality of metal cylindrical heating chamber modules connected in a vertical configuration, each module being provided with a hollow hearth which forms a substantially horizontal floor portion of the chamber, and each hearth being provided with an open portion approximatelly centered in the floor;

(b) means for passing heated gases through the hollow hearths;

(c) means in the periphery of each heating chamber for removing gases formed in that chamber;

(d) means for introducing material to be heated into an uppermost heating chamber;

(e) means for transferring heated material to successively lower heating chambers;

(f) means for removing heated material from a lowermost heating chamber;

(g) distribution means having a central shaft extending vertically through the open portions of the hearths and provided with projections for distributing introduced material upon each individual hearth;

(h) means for imparting rotational movement to the central shaft and projections; and (i) a cylindrical hollow hearth module disposed at the top of an uppermost heating chamber module to form a cover therefor, the module being connected to the means for passing heated gases therethrough.

17. The furnace defined in claim 16, wherein the modules are fabricated from stainless steel.

18. A furnace comprising:

(a) a plurality of cylindrical heating chamber modules disposed in a vertical stack relationship;

(b) hollow hearth modules disposed between the heating chamber modules;

(c) a hollow hearth module disposed above an uppermost heating chamber module;

(d) a hollow hearth module disposed below a lowermost heating chamber module;

(e) means for introducing heated gases into the hollow hearth modules;

(f) means for introducing material to be heated into the furnace; and (g) means for removing the material from the furnace.

19. A metal heating chamber module for multiple hearth furnace construction, comprising:

(a) a generally cylindrical shell;

(b) a hollow hearth forming a substantially horizontal floor in the shell, said hearth having an open portion approximately centered in the floor;

(c) means for connecting with additional heating chamber modules;

(d) means for passing heating gases through the hearth; and (e) means in the shell for removing gases from a chamber formed by the shell and hearth.

* * * * *